US010031540B2

(12) United States Patent
Mayerl

(10) Patent No.: US 10,031,540 B2
(45) Date of Patent: Jul. 24, 2018

(54) VOLTAGE REGULATOR

(71) Applicant: Infineon Technologies AG, Neubiberg (DE)

(72) Inventor: Christoph Mayerl, Ottobrunn (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 15/343,485

(22) Filed: Nov. 4, 2016

(65) Prior Publication Data

US 2017/0126130 A1 May 4, 2017

(30) Foreign Application Priority Data

Nov. 4, 2015 (DE) ..... 10 2015 118 905

(51) Int. Cl.
*G05F 1/595* (2006.01)
*G05F 1/56* (2006.01)

(52) U.S. Cl.
CPC ..... *G05F 1/595* (2013.01); *G05F 1/56* (2013.01)

(58) Field of Classification Search
CPC .. G05F 1/595; G05F 1/59; G05F 1/563; H02J 1/02; H03K 19/0016
See application file for complete search history.

(56) References Cited

U.S. PATENT DOCUMENTS 6,265,856 B1 * 7/2001 Cali' ..... G05F 1/575 323/273
6,703,813 B1 * 3/2004 Vladislav ..... G05F 1/575 323/270
6,958,595 B2 * 10/2005 Niiyama ..... H02M 3/1582 323/282
6,989,660 B2 * 1/2006 Mauthe ..... G05F 1/465 323/274
7,199,567 B2 * 4/2007 Eberlein ..... G05F 1/575 323/270
7,872,533 B2 * 1/2011 Adamski ..... H03F 1/0261 330/296
8,305,056 B2 * 11/2012 Wadhwa ..... G05F 1/56 323/270
8,680,840 B2 * 3/2014 Iacob ..... G05F 3/242 323/311

(Continued)

FOREIGN PATENT DOCUMENTS

CN 101097456 A 1/2008
CN 101458537 A 6/2009

(Continued)

*Primary Examiner* — Kyle J Moody

(74) *Attorney, Agent, or Firm* — Viering, Jentschura & Partner mbB

(57) ABSTRACT

Various embodiments provide a voltage regulator. The voltage regulator includes a supply voltage input to apply an input supply voltage, a supply voltage output to output an output supply voltage, and a first field effect transistor and a second field effect transistor, which are connected in series between the voltage supply input and the voltage supply output. The first field effect transistor has a higher operating voltage than the second field effect transistor. The voltage regulator further includes a regulator designed to set the gate voltage of the first field effect transistor and the gate voltage of the second field effect transistor to regulate the output supply voltage on the basis of a reference voltage.

17 Claims, 5 Drawing Sheets

(56) References Cited

U.S. PATENT DOCUMENTS

| | | | | |
|---|---|---|---|---|
| 2004/0256692 | A1 | 12/2004 | Kunz et al. | |
| 2008/0007234 | A1 | 1/2008 | Agari | |
| 2010/0013448 | A1 | 1/2010 | Motz | |
| 2010/0181972 | A1 | 7/2010 | Kawagoshi | |
| 2010/0308921 | A1 | 12/2010 | Adamski et al. | |
| 2012/0049815 | A1* | 3/2012 | Veeramreddi | H02M 3/158 323/282 |
| 2013/0271095 | A1* | 10/2013 | Jackum | G05F 1/56 323/270 |
| 2016/0224042 | A1* | 8/2016 | Pons | G05F 1/575 |

FOREIGN PATENT DOCUMENTS

| | | | |
|---|---|---|---|
| CN | 101782786 | A | 7/2010 |
| DE | 102005044630 | A1 | 3/2007 |
| DE | 102009032610 | A1 | 2/2010 |
| DE | 102010027263 | A1 | 1/2012 |

* cited by examiner

VOLTAGE REGULATOR

CROSS-REFERENCE TO RELATED APPLICATION

This application claims priority to German Patent Application Serial No. 10 2015 118 905.4, which was filed Nov. 4, 2015, and is incorporated herein by reference in its entirety.

TECHNICAL FIELD

Various embodiments relate generally to voltage regulators.

BACKGROUND

Electronic devices supplied with energy by an external voltage source, such as a smart card, for example, which is supplied with energy via a supply contact by a reader into which said card is inserted, typically include a voltage regulator that converts the external supply voltage into an internally required supply voltage. Efficient voltage converters are desirable which for example can be implemented with little outlay (e.g. with small area requirement) and react for example rapidly to fluctuations in the external supply voltage.

SUMMARY

Various embodiments provide a voltage regulator. The voltage regulator includes a supply voltage input to apply an input supply voltage, a supply voltage output to output an output supply voltage, and a first field effect transistor and a second field effect transistor, which are connected in series between the voltage supply input and the voltage supply output. The first field effect transistor has a higher operating voltage than the second field effect transistor. The voltage regulator further includes a regulator designed to set the gate voltage of the first field effect transistor and the gate voltage of the second field effect transistor to regulate the output supply voltage on the basis of a reference voltage.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying figures showing details and embodiments. These embodiments are described in sufficient detail that the person skilled in the art can implement the invention. Other embodiments are also possible and the embodiments can be modified from a structural, logical and electrical standpoint, without departing from the subject matter of the invention. The various embodiments are not necessarily mutually exclusive, rather it is possible to combine different embodiments with one another, thus giving rise to new embodiments. In the context of this description, the terms "connected" and "coupled" are used to describe either a direct or an indirect connection, and a direct or indirect coupling.

Figure 1:
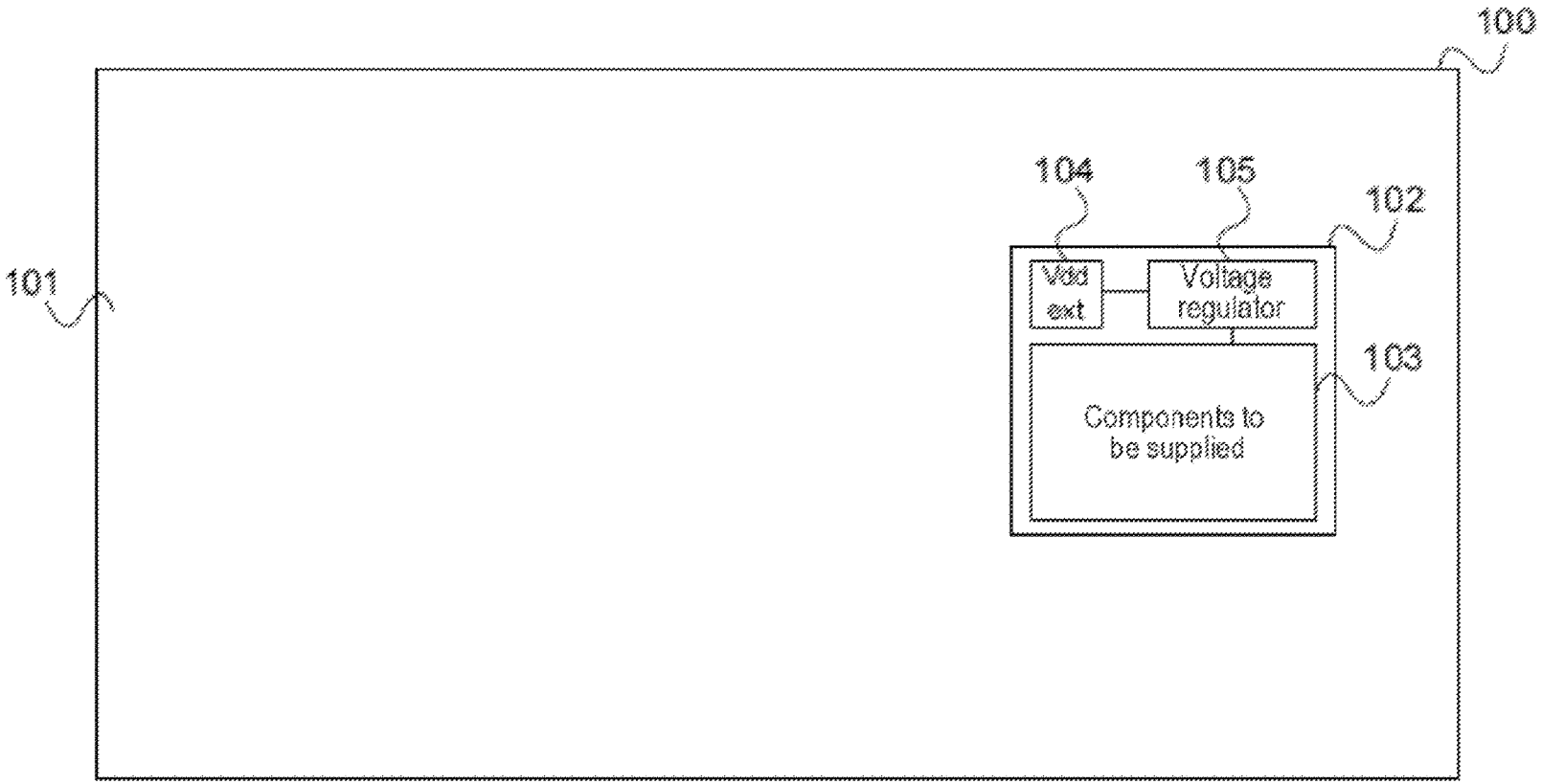
FIG. 1 shows a smart card in accordance with an embodiment.

FIG. 1 shows a smart card 100 in accordance with an embodiment.

The smart card 100 includes a smart card carrier 101 and a smart card module 102 arranged on the smart card carrier 101.

The smart card module 102 includes components 103 that require energy, for example a microprocessor (e.g. a CPU), a memory, etc.

The required energy can be supplied to the smart card module via a contact 104 (for example in combination with a grounding contact GND) from an external energy source, for example a smart card reader (e.g. a smart card reading device) into which the smart card is inserted.

If a device such as the smart card 100 is supplied via a variable external voltage (which is applied for example to the contact 104 and a grounding contact) an internally used voltage is typically kept (at least approximately) constant with the aid of a regulation. By way of example, the smart card module includes a voltage regulator 105, for example a series regulator. The voltage regulator includes for example a regulator that controls a regulation system, such that the latter supplies to the components 103 an internal supply voltage that is stabler (i.e. fluctuates less) in comparison with an applied external voltage. In this case, the internal voltage is fed to the regulator, such that the latter can control the regulation system in a suitable manner, i.e. such that a regulation of the internal supply voltage is carried out.

The regulation system of the voltage regulator 105 includes a transistor, for example. If the external voltage exceeds a maximum permissible supply voltage of a low-voltage transistor, it can be reduced by a regulation using a high-voltage transistor.

In order to be as insensitive as possible towards external voltage jumps, for example in the case of a series regulator an NMOS (n-channel metal oxide semiconductor) high-voltage transistor is used as regulating transistor since, in contrast to a PMOS (p-channel MOS), the controlled variable Vgs (gate-source voltage) does not include the external supply voltage.

However, compared with low-voltage transistors, high-voltage transistors have poorer physical properties (e.g. with regard to gain and resistance) and a larger area requirement. In order that the voltage dip per clock edge is kept small in the case of higher current consumptions, therefore, typically within an NMOS series regulator (in which the regulation system contains an n-channel MOSFET (MOS field effect transistor)), the channel width of the high-voltage regulating transistor is correspondingly increased.

As a result of the inherent regulation of the high-voltage NMOS transistor, i.e. a voltage dip at VDD instantaneously increases Vgs of the regulating transistor, the width of the regulating transistor directly influences the stability of the internal supply voltage. By way of example, a width of 5 mm is required for components 103 to be supplied having a current consumption of 4 mA, and a width of 20 mm is required for components to be supplied having a current consumption of 30 mA. On account of the area requirement of high-voltage transistors, it is necessary to find an optimum design point at which the supply stability is ensured in conjunction with the smallest possible regulating transistor.

In order that the necessary operating point of the regulating transistor can be attained even at a low external voltage that is close to the internal supply voltage to be attained, the gate of the NMOS transistor is typically driven by means of a charge pump.

In accordance with an embodiment, the performance of the voltage regulation is crucially improved by the use of a combination of a low-voltage transistor with a high-voltage transistor as regulating transistor (i.e. instead of a single regulator transistor, for example a high-voltage transistor) with the same area requirement. In this case, the better physical properties of the low-voltage transistor are manifested, such as the higher gain with smaller area than in the case of the high-voltage transistor.

In this case, the low-voltage transistor is formed by means of a triple well process in order that it can be isolated from the substrate and thus from VSS (e.g. the low supply potential, e.g. GND potential).

Figure 2:
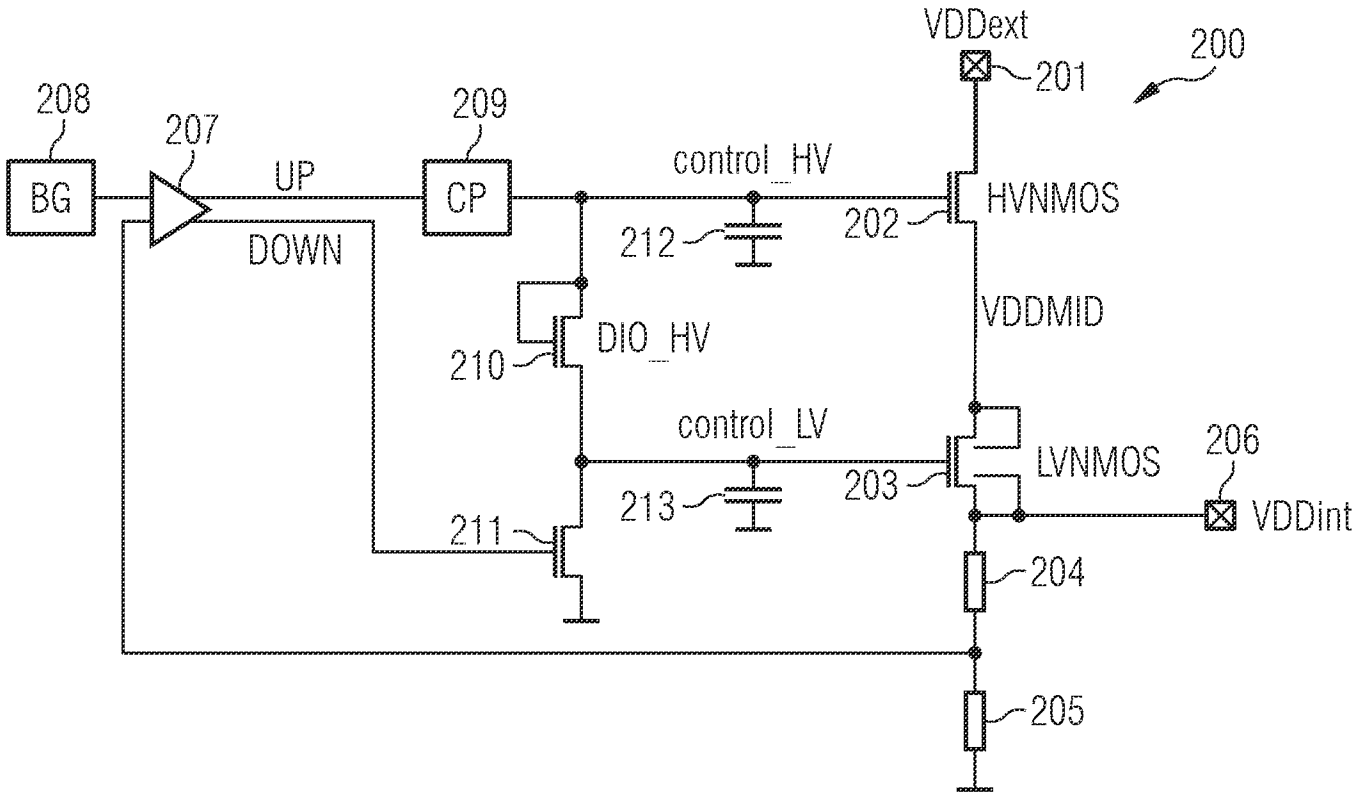
FIG. 2 shows a voltage regulator in accordance with an embodiment.

FIG. 2 shows a voltage regulator 200.

The voltage regulator 200 corresponds for example to the voltage regulator 105 of the smart card 100.

The voltage regulator includes an input 201 for applying an external supply voltage (VDDext), said input being connected for example to the contact 104 of the smart card 100. The input 201 is connected to the drain of an NMOS high-voltage transistor 202. The source of the NMOS high-voltage transistor 202 is connected to the drain 203 of an NMOS low-voltage transistor 203, the source of which is coupled to the low supply potential (which is applied to the smart card module 102 for example by means of a GND contact) via a voltage divider consisting of the series connection of a first resistor 204 and a second resistor 205.

The source of the NMOS low-voltage transistor 203 is additionally connected to an output 206 for outputting an internal supply voltage (VDDint), said output being connected for example to the components 103 to be supplied.

The NMOS low-voltage transistor 203 is formed by means of a triple well structure in which the channel region is arranged between the n-doped source region and the n-doped drain region in a p-type well arranged in turn in an n-type well situated in the p-type substrate. The configuration of the NMOS low-voltage transistor 203 by means of a triple well structure is indicated in FIG. 2 by the two terminals for the n-type well and respectively the p-type well in the circuit symbol of the NMOS low-voltage transistor 203, which are connected to the drain and respectively the source of the NMOS low-voltage transistor 203.

The center terminal of the voltage divider, i.e. the junction point between the first resistor 204 and the second resistor 205, is fed to a comparator 207 (e.g. implemented by means of an amplifier), which compares the potential at the center terminal of the voltage divider with a reference potential supplied by a reference voltage source 208. The reference voltage source is for example a band gap reference (designated by BG for "bandgap").

The comparator 207 outputs an UP signal, which is fed to a charge pump, which in reaction to the UP signal increases a control voltage control_HV at its output, said control voltage being fed to the gate of the high-voltage transistor 202.

The control voltage control_HV is additionally fed to a high-voltage diode 210, which outputs a control voltage control_LV (reduced in accordance with the voltage drop at the high-voltage diode), said control voltage being fed to the gate of the low-voltage transistor 203.

The comparator additionally outputs a DOWN signal, which is fed to the gate of a further n-channel high-voltage transistor 211, which is connected between the low supply potential and the gate of the low-voltage transistor 203 and reduces the control voltage control_HV and the control voltage control_LV in reaction to the DOWN signal.

By way of example, the comparator 207 is implemented by means of a differential amplifier, such that the UP signal is predominant if the potential at the center terminal of the voltage divider is less than the reference potential, and the DOWN signal is predominant if the potential at the center terminal of the voltage divider is greater than the reference potential.

Consequently, if the internal supply voltage VDDint is too low, the control voltages control_HV and control_LV are increased via the charge pump 209 until the target value for VDDint (defined by the reference potential and the division ratio of the voltage divider) is reached (wherein the two control voltages are connected to one another via the high-voltage diode 210). If the internal supply voltage VDDint is too high, the node with the control voltage control_LV and thus also the node with the control voltage control_HV are discharged via the further high-voltage transistor 211 until the target value for VDDint is reached.

A first capacitor 212 is connected between the gate of the high-voltage transistor 202 and the low supply potential, and a second capacitor is connected between the gate of the low-voltage transistor 203 and the low supply potential.

A description is given below of an example of the behavior of the voltage regulator 200 (in particular the profile of the control voltages control_HV and control_LV) when an external supply voltage is applied, wherein firstly the behavior of a voltage regulator including a (single) high-voltage transistor in the regulation system is described for comparison.

Figure 3:
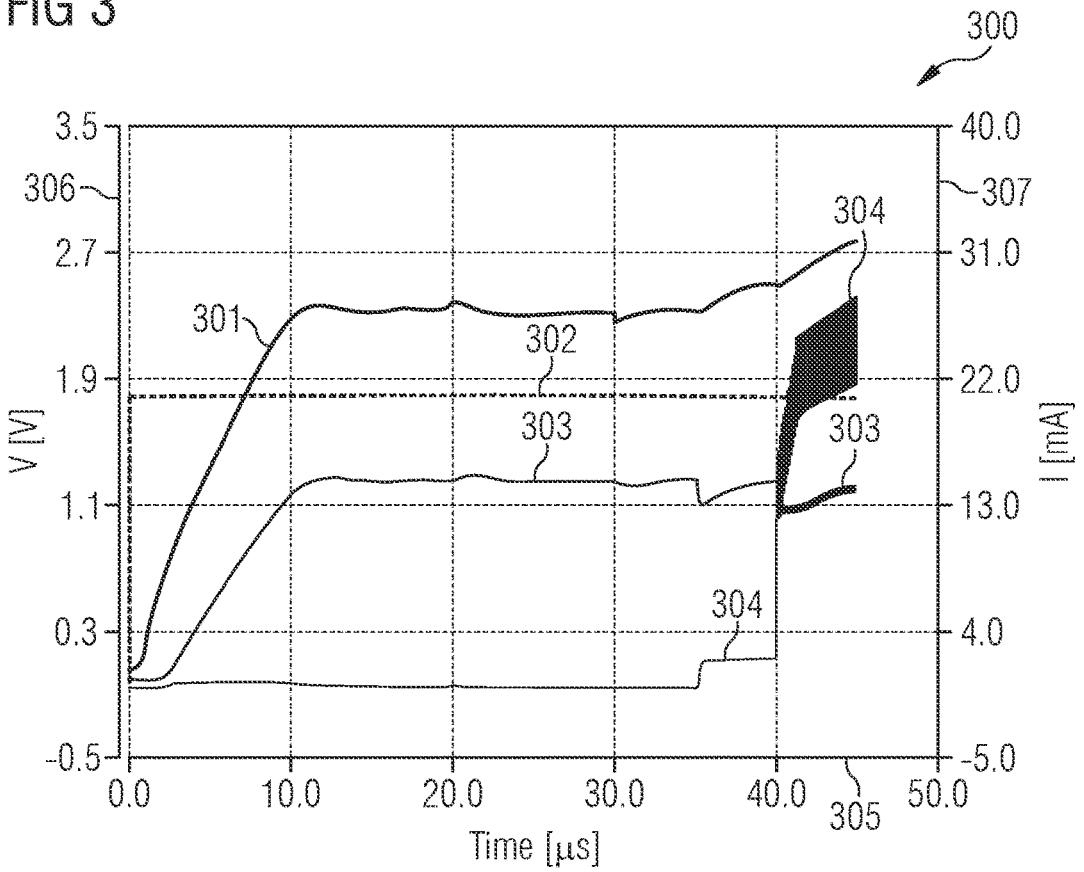
FIG. 3 shows a diagram illustrating the behavior of a voltage regulator including an individual high-voltage transistor in the regulation system.

FIG. 3 shows a diagram 300 illustrating the behavior of a voltage regulator including an individual high-voltage transistor in the regulation system.

A first curve 301 shows the control signal fed to the gate of the high-voltage transistor, a second curve 302 shows the profile of the applied external voltage, a third curve 303 shows the profile of the generated internal voltage, and a fourth curve 304 shows the profile of the current through the regulation system.

Time runs from left to right in accordance with a horizontal time axis 305 and voltage and current increase from the bottom to the top in accordance with a vertical voltage axis 306 and a vertical current axis 307, respectively.

Figure 4:
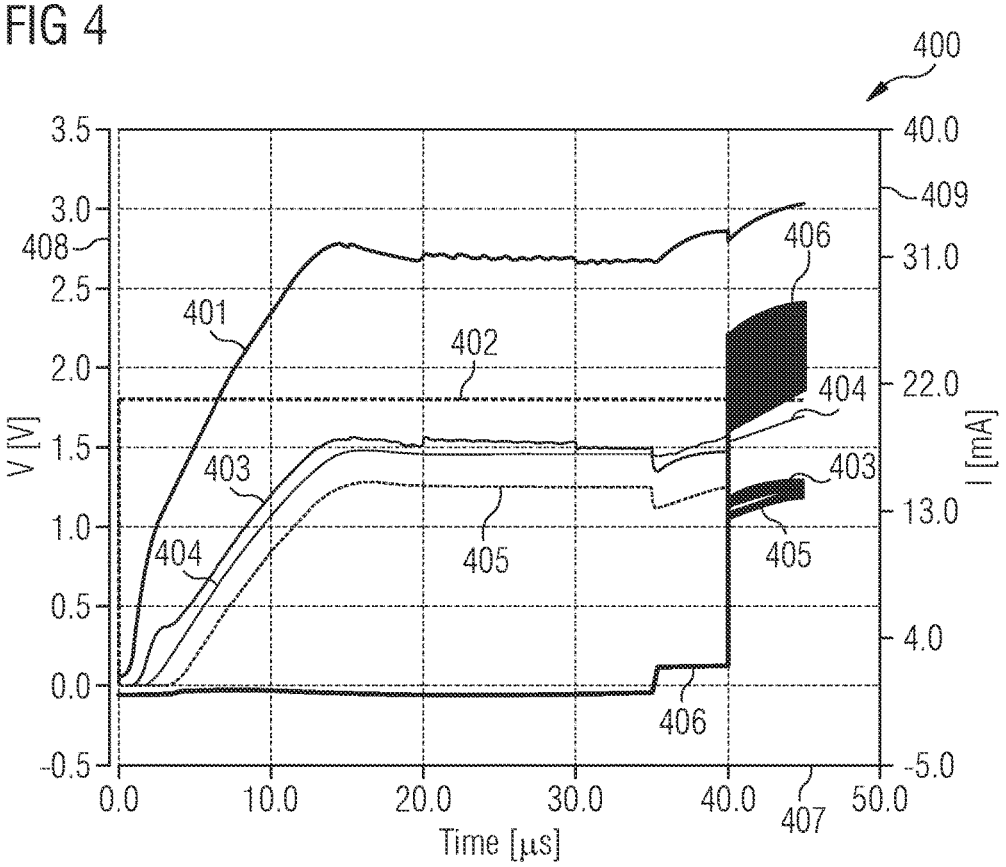
FIG. 4 shows a diagram illustrating the behavior of the voltage regulator illustrated in FIG. 2.

FIG. 4 shows a diagram 400 illustrating the behavior of the voltage regulator 200 illustrated in FIG. 2.

A first curve 401 shows the control signal control_HV, a second curve 402 shows the profile of the applied external voltage, a third curve 403 shows the profile of the potential at the node connecting the high-voltage transistor 202 to the low-voltage transistor 203 (that is to say illustratively in the center of the regulation system), a curve 404 shows the control signal control_LV, a fifth curve 405 shows the profile of the generated internal voltage, and a sixth curve 406 shows the profile of the current through the regulation system.

As in FIG. 3, time runs from left to right in accordance with a horizontal time axis 407 and voltage and current increase from the bottom to the top in accordance with a vertical voltage axis 408 and a vertical current axis 409, respectively.

In the examples in FIG. 3 and FIG. 4, the external supply voltage has a value of 1.8 V. Other possible values are 5 V and 3 V, for example. The internal supply voltage to be attained is 1.25 V for example. The reference voltage source 208 supplies 0.8 V, for example.

It can be discerned that, by means of the voltage regulator 200 illustrated in FIG. 2, the setpoint output voltage and the setpoint current are attained more rapidly since no or fewer clock cycles are masked out on account of the excessively low voltage (which is the reason for the slower rise in the variant in FIG. 3). Furthermore, a smaller dip in the supply voltage upon loading, a smoother supply voltage and a smaller operating voltage punch-through are achieved.

Figure 5:
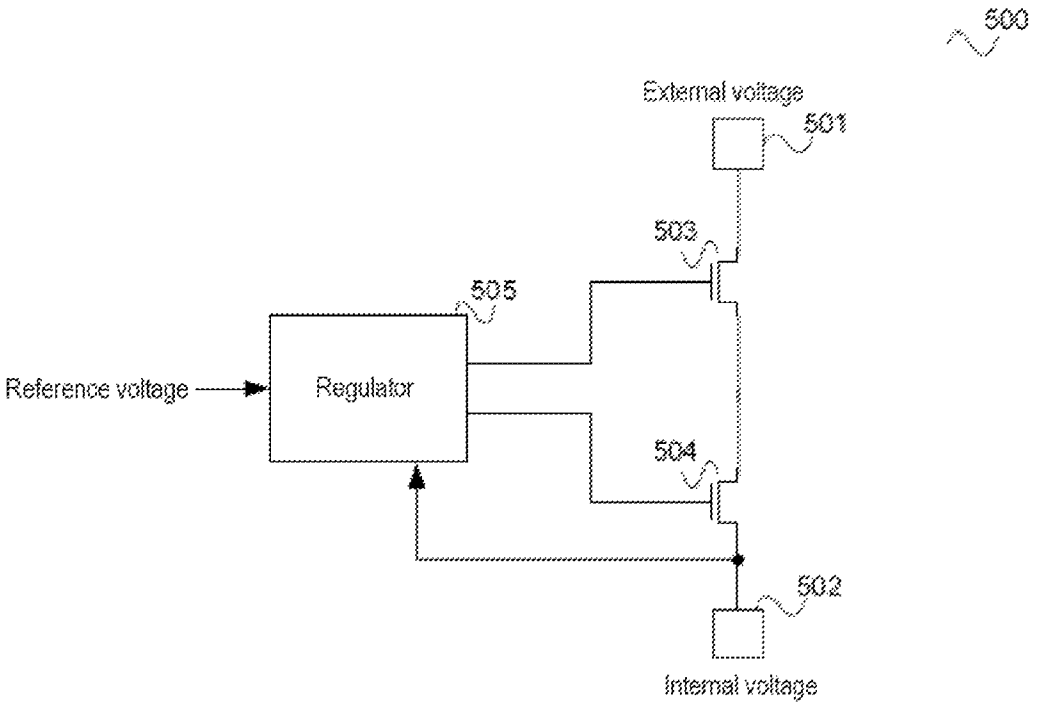
FIG. 5 shows a voltage regulator in accordance with an embodiment.

To summarize, in accordance with various embodiments, a voltage regulator as illustrated in FIG. 5 is provided.

FIG. 5 shows a voltage regulator 500 in accordance with an embodiment.

The voltage regulator 500 includes a supply voltage input 501 to apply an input supply voltage and a supply voltage output 502 to output an output supply voltage.

The voltage regulator 500 furthermore includes a first field effect transistor 503 and a second field effect transistor 504, which are connected in series between the voltage supply input and the voltage supply output. The first field effect transistor 503 has a higher operating voltage than the second field effect transistor 504.

The voltage regulator 500 furthermore includes a regulator 505 configured to set the gate voltage of the first field effect transistor and the gate voltage of the second field effect transistor for regulating the output supply voltage on the basis of a reference voltage.

In other words, in a voltage regulator, a cascode including an (e.g. NMOS) high-voltage transistor and an (e.g. NMOS) low-voltage transistor is used for example instead of a high-voltage NMOS regulating transistor. The manipulated variable is fed both to the gate of the high-voltage transistor and (for example via a diode) to the gate of the low-voltage transistor. The output supply voltage (e.g. an internal supply voltage) is for example lower than the input supply voltage (e.g. an external supply voltage) and the regulator is designed to drive the field effect transistors in such a way, i.e. to set the gate voltage of the first field effect transistor and the gate voltage of the second field effect transistor in such a way, that the fluctuations (i.e. the percentage fluctuations) of the output supply voltage are smaller than the fluctuations of the input supply voltage.

The voltage regulator 500 corresponds for example to the voltage regulator of a smart card, e.g. as described with reference to FIG. 1.

The first field effect transistor is for example a high-voltage transistor and the second field effect transistor is a low-voltage transistor, which for example includes the fact that the operating voltage of the first field effect transistor is higher than that of the second field effect transistor (that is to say that in the case of the first field effect transistor the voltage that can be applied between drain and source before said field effect transistor undergoes breakdown is a higher voltage than in the case of the second field effect transistor) or else that the gate-bulk operating voltage in the case of the first field effect transistor is higher than that in the case of the second field effect transistor. By way of example, the breakdown voltages in the case of the first field effect transistor can be higher (e.g. by a factor of 2 or more, 5 or more or 10 or more) than those in the case of the second field effect transistor. In other words, the fact that the first field effect transistor is a high-voltage transistor and the second field effect transistor is a low-voltage transistor can include the fact that the first field effect transistor has a higher dielectric strength than the second field effect transistor (for example by a factor of 2 or more, 5 or more or 10 or more).

The fact that the first field effect transistor is a high-voltage transistor and the second field effect transistor is a low-voltage transistor can furthermore include the fact that the gate oxide in the case of the first field effect transistor is thicker than that in the case of the second field effect transistor.

By way of example, the first field effect transistor has an operating voltage of 8 V and the second low-voltage transistor has an operating voltage of 1.25 V.

Various embodiments are specified below.

Embodiment 1 is a voltage regulator as described with reference to FIG. 5.

Embodiment 2 is a voltage regulator in accordance with embodiment 1, wherein the first field effect transistor is a high-voltage transistor and the second field effect transistor is a low-voltage transistor.

Embodiment 3 is a voltage regulator in accordance with embodiment 1 or 2, wherein the first field effect transistor has a higher resistance than the second field effect transistor.

Embodiment 4 is a voltage regulator in accordance with any of embodiments 1 to 3, wherein the first field effect transistor has a higher gate oxide thickness than the second field effect transistor.

Embodiment 5 is a voltage regulator in accordance with any of embodiments 1 to 4, wherein the second field effect transistor has a larger channel width than the first field effect transistor.

Embodiment 6 is a voltage regulator in accordance with any of embodiments 1 to 5, wherein the second field effect transistor has a higher gain than the first field effect transistor.

Embodiment 7 is a voltage regulator in accordance with any of embodiments 1 to 6, wherein the first field effect transistor and the second field effect transistor form a cascode.

Embodiment 8 is a voltage regulator in accordance with any of embodiments 1 to 7, wherein the regulator is designed to regulate the output supply voltage to a desired voltage value.

Embodiment 9 is a voltage regulator in accordance with embodiment 8, wherein the desired voltage value is given by the reference voltage.

Embodiment 10 is a voltage regulator in accordance with any of embodiments 1 to 9, wherein the regulator is designed to increase the gate voltage of the first field effect transistor and the gate voltage of the second field effect transistor if the output supply voltage is lower than the desired voltage value, and to reduce the gate voltage of the first field effect transistor and the gate voltage of the second field effect transistor if the output supply voltage is higher than the desired voltage value.

Embodiment 11 is a voltage regulator in accordance with embodiment 10, wherein the regulator includes a charge pump and is designed to increase the gate voltage of the first field effect transistor and the gate voltage of the second field effect transistor by means of the charge pump.

Embodiment 12 is a voltage regulator in accordance with embodiment 10 or 11, wherein the regulator includes a further field effect transistor, which is connected firstly to the gate of the first field effect transistor and the gate of the second field effect transistor and secondly to the low supply potential, and the regulator is designed to reduce the gate voltage of the first field effect transistor and the gate voltage of the second field effect transistor by means of opening the further field effect transistor.

Embodiment 13 is a voltage regulator in accordance with any of embodiments 1 to 12, wherein the regulator includes a comparator designed to compare the reference voltage with a comparison voltage representing the output supply voltage, and the regulator is designed to set the gate voltage of the first field effect transistor and the gate voltage of the second field effect transistor on the basis of the result of the comparison.

Embodiment 14 is a voltage regulator in accordance with embodiment 13, including a voltage divider, which is connected to the voltage supply output and is designed to generate the comparison voltage from the output supply voltage.

Embodiment 15 is a voltage regulator in accordance with any of embodiments 1 to 14, wherein the gate of the first field effect transistor is coupled to the anode of a diode and the gate of the second field effect transistor is coupled to the cathode of the diode.

Embodiment 16 is a voltage regulator in accordance with embodiment 15, wherein the diode is implemented by means of a field effect transistor connected as a diode.

Embodiment 17 is a voltage regulator in accordance with any of embodiments 1 to 16, wherein the second field effect transistor is formed in a triple well structure.

Embodiment 18 is a voltage regulator in accordance with any of embodiments 1 to 17, wherein the first field effect transistor and the second field effect transistor are n-channel field effect transistors.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A voltage regulator, comprising:

a voltage supply input to apply an input supply voltage;

a voltage supply output to output an output supply voltage;

a first field effect transistor and a second field effect transistor, which are connected in series between the voltage supply input and the voltage supply output, wherein the first field effect transistor has a higher operating voltage than the second field effect transistor; and a regulator designed to set a gate voltage of the first field effect transistor and a gate voltage of the second field effect transistor to regulate the output supply voltage based on a reference voltage;

wherein the regulator comprises a further field effect transistor, which is connected firstly to the gate of the first field effect transistor and the gate of the second field effect transistor and secondly to a low supply potential, and the regulator is designed to reduce the gate voltage of the first field effect transistor and the gate voltage of the second field effect transistor by means of opening the further field effect transistor.

2. The voltage regulator of claim 1, wherein the first field effect transistor is a high-voltage transistor and the second field effect transistor is a low-voltage transistor.

3. The voltage regulator of claim 1, wherein the first field effect transistor has a higher resistance than the second field effect transistor.

4. The voltage regulator of claim 1, wherein the first field effect transistor has a higher gate oxide thickness than the second field effect transistor.

5. The voltage regulator of claim 1, wherein the second field effect transistor has a larger channel width than the first field effect transistor.

6. The voltage regulator of claim 1, wherein the second field effect transistor has a higher gain than the first field effect transistor.

7. The voltage regulator of claim 1, wherein the first field effect transistor and the second field effect transistor form a cascode.

8. The voltage regulator of claim 1, wherein the regulator is designed to regulate the output supply voltage to a desired voltage value.

9. The voltage regulator of claim 8, wherein the desired voltage value is given by the reference voltage.

10. The voltage regulator of claim 1, wherein the regulator is designed to increase the gate voltage of the first field effect transistor and the gate voltage of the second field effect transistor if the output supply voltage is lower than a desired voltage value, and to reduce the gate voltage of the first field effect transistor and the gate voltage of the second field effect transistor if the output supply voltage is higher than the desired voltage value.

11. The voltage regulator of claim 10, wherein the regulator comprises a charge pump and is designed to increase the gate voltage of the first field effect transistor and the gate voltage of the second field effect transistor by means of the charge pump.

12. The voltage regulator of claim 1, wherein the regulator comprises a comparator designed to compare the reference voltage with a comparison voltage representing the output supply voltage, and the regulator is designed to set the gate voltage of the first field effect transistor and the gate voltage of the second field effect transistor based on the result of the comparison.

13. The voltage regulator of claim 1, further comprising:

a voltage divider, which is connected to the voltage supply output and is designed to generate the comparison voltage from the output supply voltage.

14. The voltage regulator of claim 1, wherein the gate of the first field effect transistor is coupled to an anode of a diode and the gate of the second field effect transistor is coupled to a cathode of the diode.

15. The voltage regulator of claim 14, wherein the diode is implemented by means of a field effect transistor connected as a diode.

16. The voltage regulator of claim 1, wherein the second field effect transistor is formed in a triple well structure.

17. The voltage regulator of claim 1, wherein the first field effect transistor and the second field effect transistor are n-channel field effect transistors.

* * * * *